US005282582A

United States Patent [19]

Sugioka et al.

[11] Patent Number: 5,282,582

[45] Date of Patent: Feb. 1, 1994

[54] YARN TRAVERSING APPARATUS

[75] Inventors: Takami Sugioka; Toshiyuki Ueno; Yo Sakai, all of Matsuyama, Japan

[73] Assignee: Teijin Seiki Co., Ltd., Osaka, Japan

[21] Appl. No.: 905,195

[22] Filed: Jun. 26, 1992

Related U.S. Application Data

[63] Continuation of Ser. No. 514,189, Apr. 25, 1990, abandoned.

[30] Foreign Application Priority Data

Apr. 28, 1989 [JP] Japan ..... 1-110133
Sep. 19, 1989 [JP] Japan ..... 1-242761

[51] Int. Cl.[5] ..... B65H 54/28
[52] U.S. Cl. ..... 242/43 A
[58] Field of Search ..... 242/43 A, 158 B, 18.1

[56] References Cited

U.S. PATENT DOCUMENTS 3,362,652 1/1968 Butterworth ..... 242/43 A
3,650,486 3/1972 Hasegawa et al. ..... 242/43 A
4,561,603 12/1985 Schippers et al. ..... 242/43 A
4,674,694 6/1987 Hasegawa et al. ..... 242/43 A
4,915,315 4/1990 Kamp et al. ..... 242/43 A
4,991,783 2/1991 Sugioka ..... 242/43 A
5,149,002 9/1992 Sugioka ..... 242/43 A

FOREIGN PATENT DOCUMENTS 46-36258 10/1971 Japan .
59194977 7/1978 Japan .
5322178 5/1984 Japan .

*Primary Examiner*—Daniel P. Stodola
*Assistant Examiner*—Michael R. Mansen
*Attorney, Agent, or Firm*—Rothwell, Figg, Ernst & Kurz

[57] ABSTRACT

A yarn traversing apparatus includes a first traverse member having rotary blades for traversing a yarn from a center toward ends of a traverse stroke, and a second traverse member having rotary blades for traversing the yarn from the ends toward the center of the traverse stroke in order to wind the yarn onto a bobbin to form a yarn package. Guide rails are provided so as to maintain the speed of the yarn constant as it is conveyed by the first traverse member, and to gradually decrease the speed of the yarn from the ends of the traverse stroke to the center of the traverse stroke as it is conveyed by the second traverse member, from a speed that is 1.5 to 7 times that of the first traverse member, to a speed substantially the same as that of the first traverse member.

7 Claims, 10 Drawing Sheets

YARN TRAVERSING APPARATUS

This is a continuation of application Ser. No. 07/514,189, filed Apr. 25, 1990, now abandoned.

BACKGROUND OF THE INVENTION

This invention relates to a yarn traversing apparatus for obtaining a wound yarn package at a high speed winding with a good wound shape and without cob-webbing.

More specifically, the present invention relates to a yarn traversing apparatus, which comprises at least one pair of rotary blades which rotate in opposite directions and a mechanism for transferring the yarn between the blades.

Conventionally known yarn traversing apparatus of the above-described type are, for example, disclosed in Japanese Patent Publication No. Sho 53-22178, Japanese Patent Publication No. Sho 46-36258, and Japanese Patent Laid-open No. Sho 59-194977.

However, in these conventionally known apparatus, the yarn temporarily becomes free i.e., the yarn becomes in an unstable condition, when the yarn is transferred from one of the oppositely rotating yarn guides to the other yarn guide. Accordingly, there occurs a disadvantage that the obtained yarn quality is deteriorated because high shoulders are formed at ends of the package corresponding to traverse ends.

Further, there occurs another disadvantage, which is sometimes referred to as "cob-webbing" and wherein a yarn wound on the shoulders is slipped down from the shoulders.

In addition, in the conventionally known apparatus, since a so called "free length", i.e., a distance from the yarn guide to the contact roller, becomes long, there occurs the result that excessively high shoulders occur.

Besides, in the conventional apparatus, when a yarn is wound at a high speed higher than 5,000 m/min, the yarn is fluctuated due to the moment of inertia when the traverse motion is reversed, and the above-described disadvantages are even further pronounced.

Furthermore, in the conventional apparatus, since a common guide rail is disposed corresponding to rotary blades which are rotating in opposite directions and since the rotary blades rotating in opposite directions are arranged adjacent to each other, the traverse speed cannot be set freely. As a result, the following problems are inherent to the apparatus.

When the yarn is moved from the center of the traverse stroke toward the end of the traverse stroke, the yarn is moved behind the movement of the rotary blade by a distance equal to a distance from the position of the rotary blade to the point where the yarn reaches the contact roller multiplied by tan $\theta$, wherein $\theta$ is a winding angle. Further, when the traverse motion of the yarn is reversed at the end of the traverse stroke, the winding angle $\theta$ is also reversed, and the movement of the yarn in a traversing direction is temporarily stopped while the traverse motion is reversed. Thus, high shoulders are generated at the ends of the obtained package. Accordingly, the yarn quality may be deteriorated because of the high shoulders, and cob-webbing may occur due to loosening of the yarn.

SUMMARY OF THE INVENTION

It is an object of the present invention to provide a new yarn traversing apparatus, by which the above-described disadvantages are obviated.

It is another object of the present invention to provide a yarn traversing apparatus, by which a yarn is consistently traversed and wound in a package without forming high shoulders or cob-webbing.

According to the present invention, the above-described disadvantages are obviated and the above-described objects are achieved by a yarn traversing apparatus for traversing a yarn which is to be wound onto a bobbin to form a yarn package. The yarn traversing apparatus of the present invention is installed in a yarn winding apparatus comprising a bobbin holder for inserting the bobbin thereon and, a contact roller pressed onto the bobbin and the yarn traversing apparatus. The yarn traversing apparatus of the present invention comprises:

a first traverse means, which is disposed downstream by a predetermined distance from a fulcrum for traverse motion, for traversing the yarn from a center toward ends of a traverse stroke; and a second traverse means, which is disposed downstream by a predetermined distance from the first traverse means, for traversing the yarn from the ends of traverse stroke toward the center of traverse stroke;

the first traverse means comprising a rotary blade moving from the center of traverse motion toward the ends of traverse stroke and a guide rail restricting a speed of the yarn conveyed by the rotary blade, so that the speed of the yarn conveyed by the first traverse means is made substantially constant;

the second traverse means comprising a rotary blade moving from the ends of traverse stroke toward the center of traverse motion and a guide rail restricting a speed of the yarn conveyed by the rotary blade of the second traverse means, so that a speed of the yarn conveyed by the second traverse means is made almost same as that of the first traverse means at the center of traverse motion and is gradually decreased from a speed between 1.5 and 7 times that of the first traverse means to that of the first traverse means at the ends of traverse motion.

It is preferred that the yarn is released from the first traverse means after the yarn is moved by the second traverse means to a position deviated toward the center of traverse stroke from an imaginary line connecting the first traversing means and a point where the yarn is in contact with the contact roller, when the yarn moved to the end of the traverse stroke by the first traverse means is engaged with the second traverse means. In order to move and release the yarn as described above, it is preferred for the yarn traversing apparatus to be so arranged that the following equations are satisfied.

$$S1 \geqq S0 + 2L1 \tan \theta$$

$$S2 \geqq S0 + 2L2 \tan \theta$$

wherein the parameters are defined as follows:

S0 is the stroke of the yarn wrapping around the contact roller:

S1 is the stroke of the first traverse means when it releases the yarn:

S2 is the stroke of the second traverse means at that time:

L1 is a distance from the first traverse means to the wrapping point on the contact roller;

L2 is a distance from the second traverse means to the wrapping point on the contact roller; and is a winding angle of the yarn.

BRIEF DESCRIPTION OF THE DRAWINGS

The present invention will now be explained in detail with reference to the accompanying drawings, wherein.

PREFERRED EMBODIMENTS

One preferred embodiment of the present invention will now be described with reference to the accompanying drawings.

Figure 1:
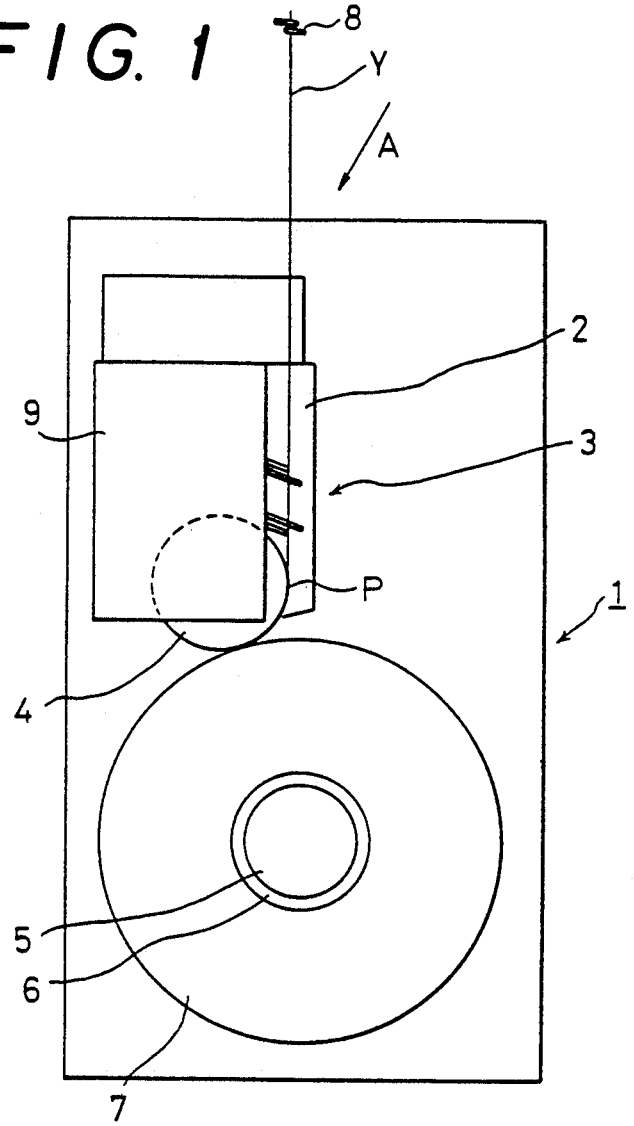
FIG. 1 is a schematic front view of a winding apparatus wherein the traversing apparatus of the present invention is installed.

Referring to FIG. 1 which is a schematic view seen from the front of a winding apparatus of the present invention, after a yarn Y is drawn by a drawing apparatus (not illustrated), the yarn Y is fed through a snail guide 8, which serves as a fulcrum of traverse motion, and is wound by a winding apparatus 1.

Upon winding operation, while the yarn Y is traversed to and fro (in a direction perpendicular to the sheet) by a traversing apparatus 3, it reaches a contact roller 4 at a point P and wraps around the contact roller 4.

Two bobbins 6 are inserted onto a bobbin holder 5 and are frictionally driven by the contact roller 4. Thus, two yarns Y wrapping around the contact roller 4 are simultaneously wound onto the bobbins 6 to form two yarn packages 7. However, the description below is with reference to a single yarn for simplicity of explanation.

The contact roller 4 is rotatably mounted on a frame 9 projecting from a slide block 2 which is vertically movable along the winding machine 1. The frame 9 further has the traversing apparatus 3 mounted thereon above the contact roller 4, which apparatus performs the traversing operation.

The construction of the traversing apparatus 3 of the present embodiment will now be explained in detail.

Figure 2:
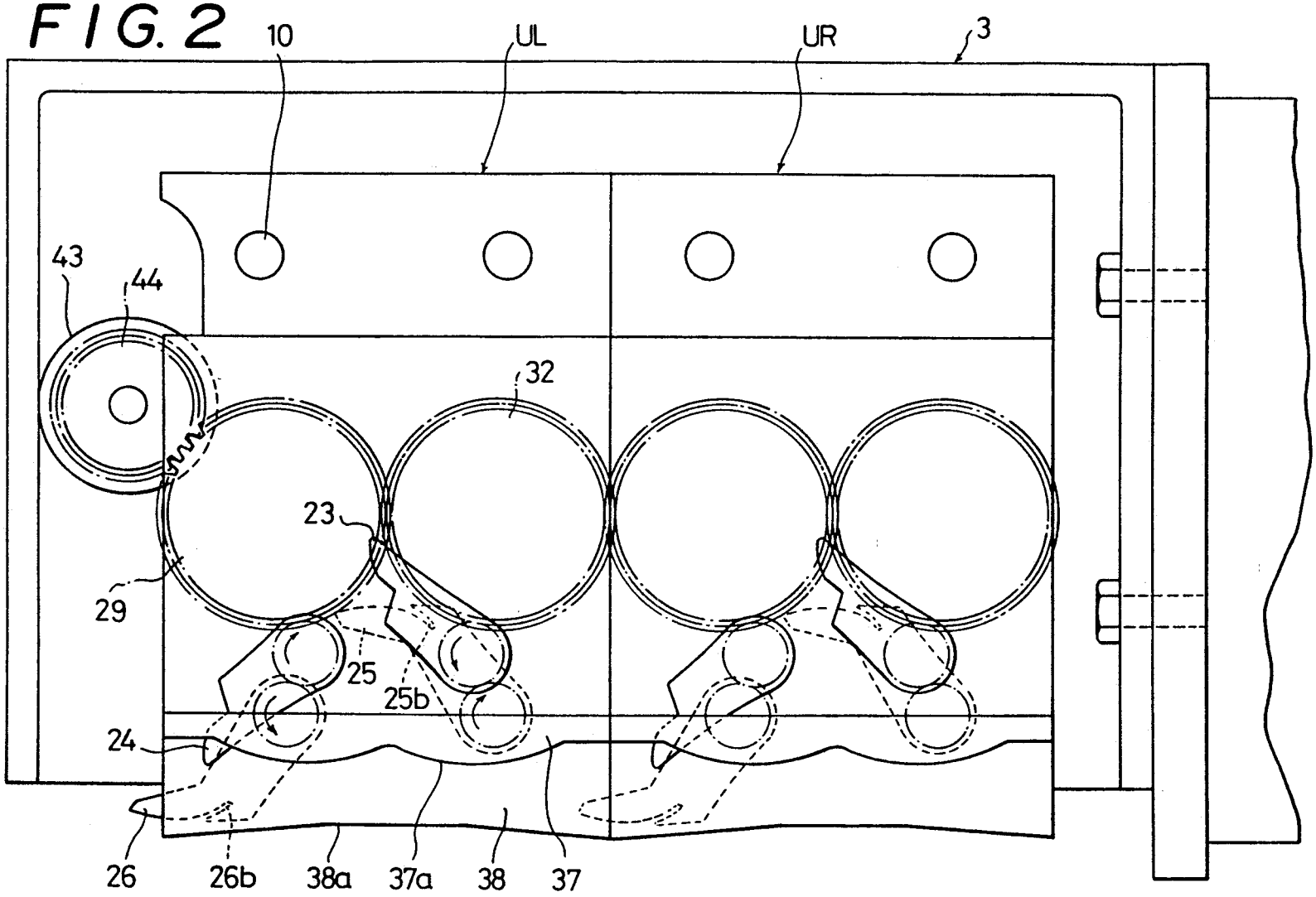
FIG. 2 is a plan view showing the traversing apparatus according to an embodiment of the present invention.

As illustrated in FIG. 2, the traversing apparatus 3 comprises a pair of units UL and UR which are horizontally disposed relative to each other and which are detachably secured to the frame 9 by bolts 10.

Figure 3:
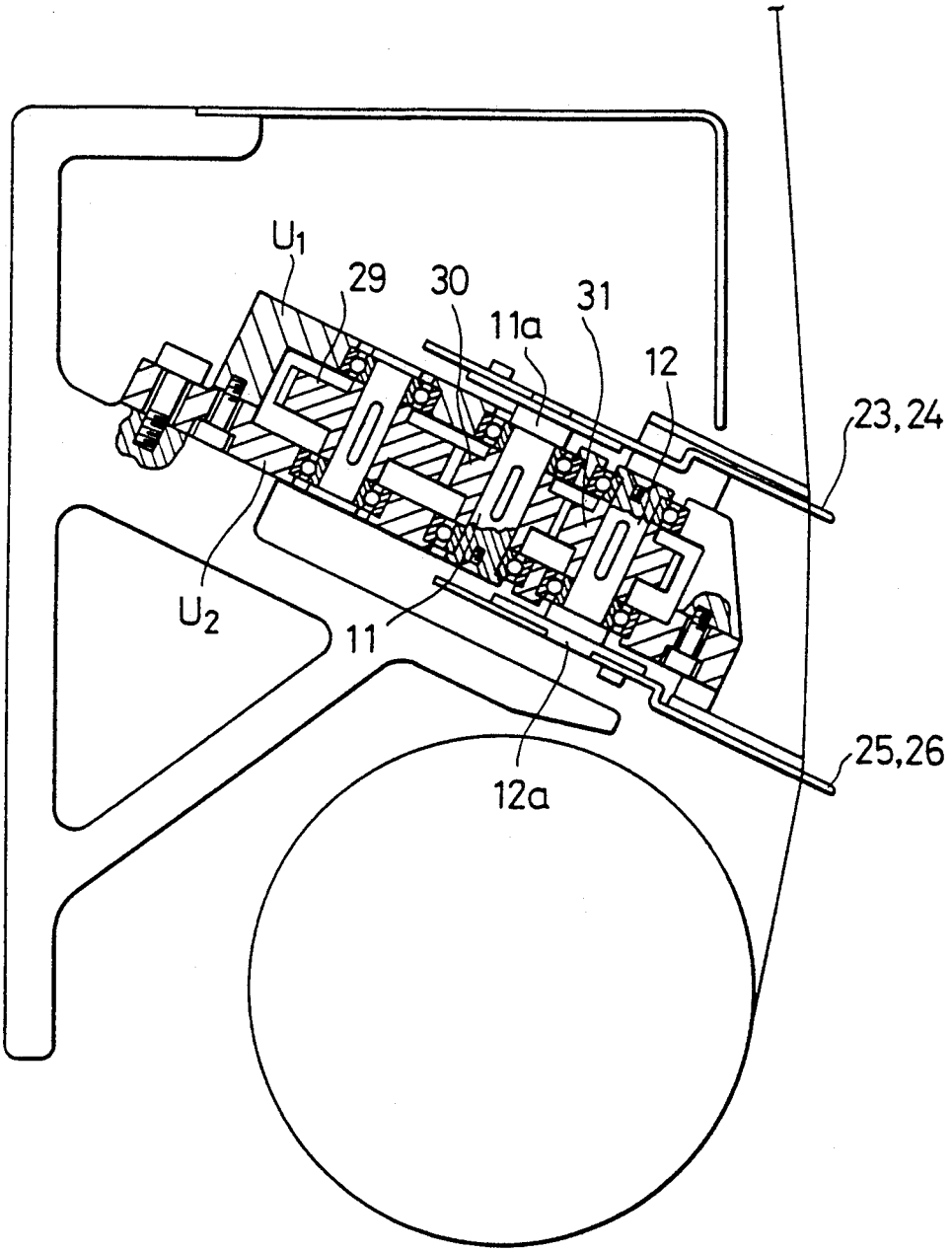
FIG. 3 is a detailed cross sectional view of a traverse unit in FIG. 2.

As illustrated in FIG. 3, each of the units UL and UR constituting the traversing apparatus 3 comprises two members U1 and U2, which are disposed upwardly and downwardly, respectively.

FIG. 3 is a detailed cross sectional view of one of the traverse units illustrated in FIG. 2.

The upward traverse member U1 includes rotary blades 23 and 24 for traversing the yarn Y, and the downward traverse member U2 also includes rotary blades 25 and 26 for traversing the yarn Y.

As illustrated in FIG. 2, the frame 9 has an electric motor 43 disposed at the front end thereof. The rotation of the motor 43 is transmitted to a gear 29 of the unit UL through a gear 44 which is attached to the output spindle of the motor 43. The gear 29 engages with an adjacent gear 32, which in turn transmits the power to the unit UR.

Reference numerals 11*a* and 12*a* (see FIG. 3) denote brackets formed at the upper and lower ends of spindles 11 and 12, respectively, which brackets serve to secure the rotary blade 23 of the upward traverse member U1 and the rotary blade 25 of the downward traverse member U2 to the spindles 11 and 12, respectively.

The rotary blades 23 and 24 of the upward traverse member U1, which will be referred to as the first traverse means hereinbelow, are so arranged that they convey the yarn Y from the center of the traverse stroke to the ends of the traverse stroke. Contrary to this, the rotary blades 25 and 26 of the downward traverse member U2, which will be referred to as the second traverse means hereinbelow, are so arranged that they convey the yarn Y from the ends of the traverse stroke to the center of the traverse stroke.

Figure 4:
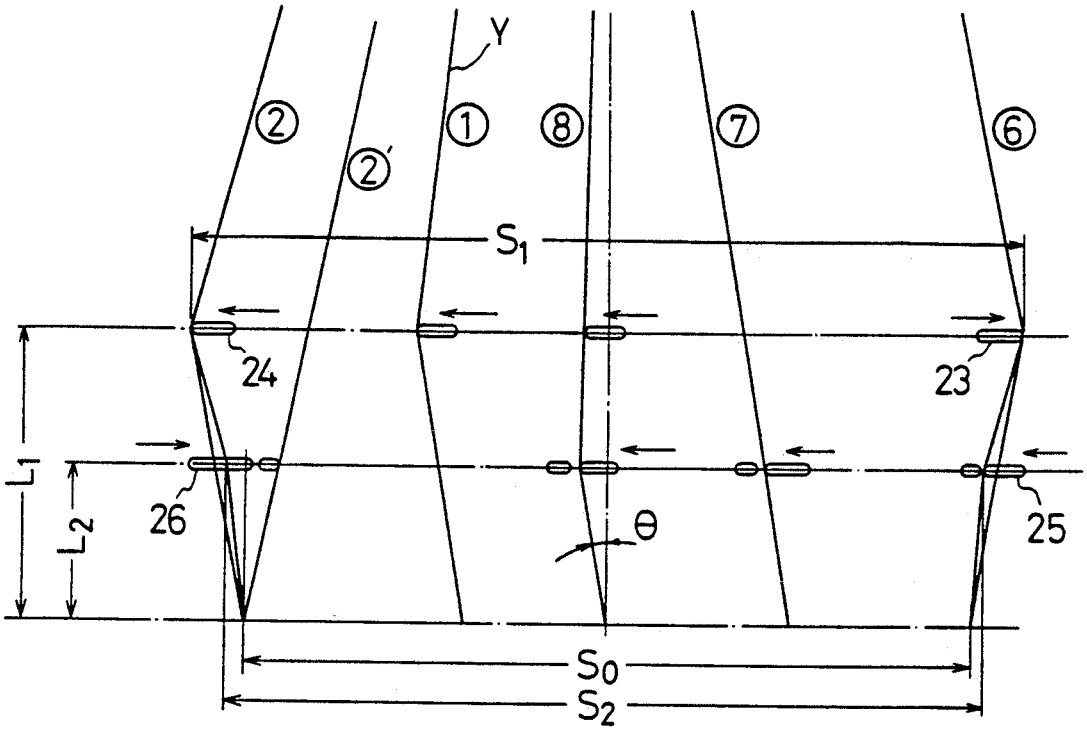
FIGS. 4 and 5 are front views, sequentially showing the conditions wherein a yarn is transferred while it is traversed.

As it is clearly shown in FIG. 4, the traverse member U1 and U2 are so arranged that planes which are formed by the rotations of the blades 23, 24, 25 and 26 are perpendicular to a plane formed by the traversing motion of the yarn Y or that the former planes are inclined downward (in this embodiment 30°) in a feeding direction of the yarn Y relative to the latter plane formed by the traversing motion of the yarn Y.

A guide 37 (FIG. 2) is secured to the member U1, and a guide 38 is secured to the member U2. The shape of guide rail 37*a* formed on the guide 37 is so selected that the yarn Y is traversed at a substantially constant speed along the guide rail 37*a* by the rotary blades 23 and 24.

In the meantime, the shape of the guide rail 38*a* formed on the guide 38 is so selected that when the yarn Y is conveyed by the rotary blades 25 and 26, a speed of the yarn Y conveyed by the rotary blades 25 and 26 is made almost the as that by the rotary blades 23 and 24 at the center of traverse motion and is gradually decreased from a speed between 1.5 and 7 times that by the rotary blades 23 and 24 to that by the rotary blades 23 and 24 at the ends of traverse motion.

Arrows in FIG. 2 show the rotational directions of the rotary blades.

Due to the above-described construction, the yarn Y is moved by the rotary blade 24 of the first traverse means from the center of the traverse stroke toward one of the ends of traverse stroke. Then, the yarn Y at the end of the traverse stroke is transferred to the rotary blade 26 of the second traverse means and is moved from the end of the traverse stroke toward a center of the traverse stroke. Thereafter, traversing of the yarn Y from the center of traverse stroke is taken over by the rotary blade 23 of the the first traverse means, and when the yarn Y reaches the other end of the traverse stroke, the yarn Y is transferred to the rotary blade 25 of the second traverse means. Thus, the yarn Y is again moved toward the center of traverse stroke. The traversing operation is repeated in a the foregoing manner.

The distance between the rotary blades 23 and 24, and 25 and 26 of the first and second traverse means may be the same.

Figure 5:
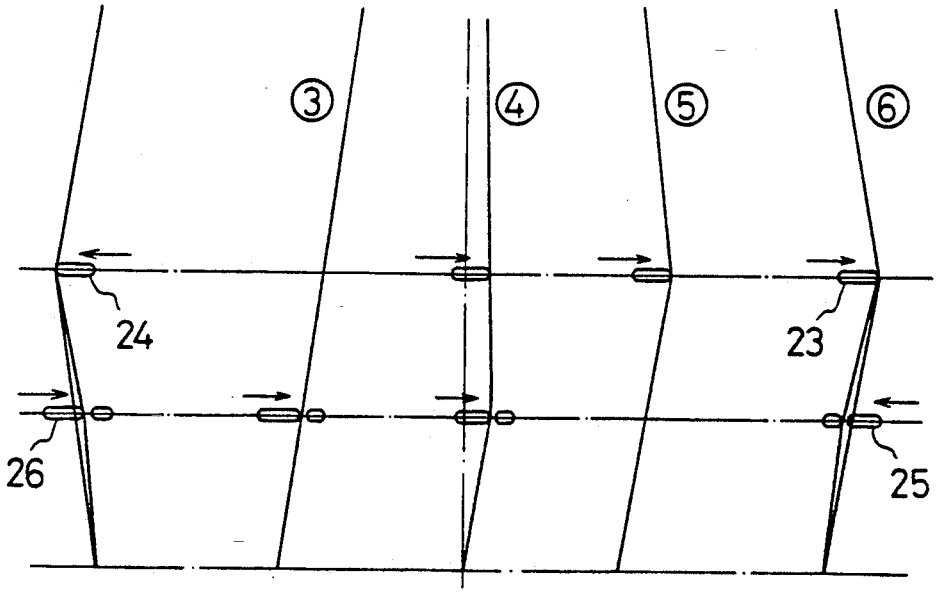
Figure 6A:
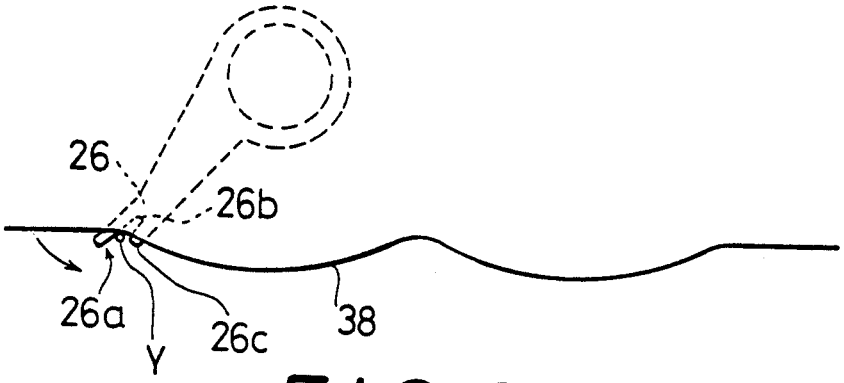
FIGS. 6 (*a*) to 6 (*c*) are schematic plan views showing the shapes of blades 25 and 26 and transfer of the yarn.
Figure 6B:
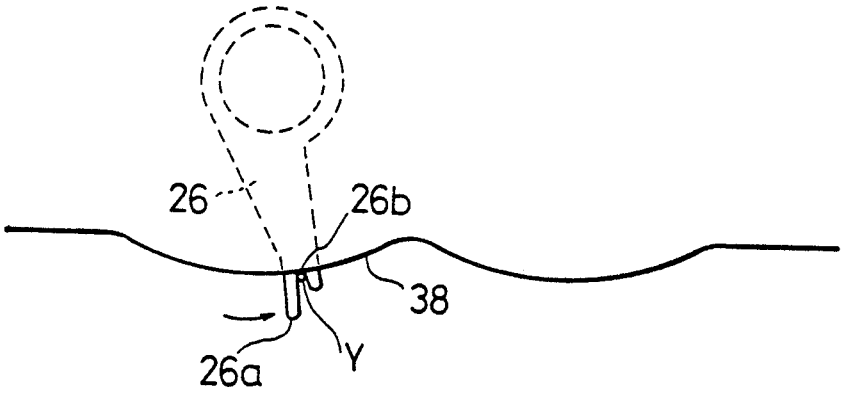
Figure 6C:
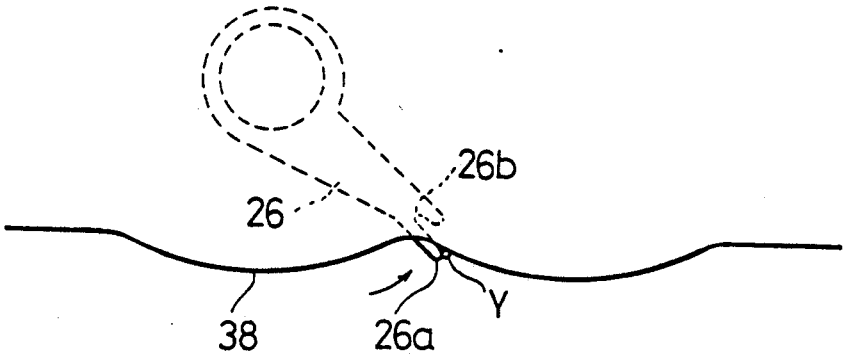
Figure 7A:
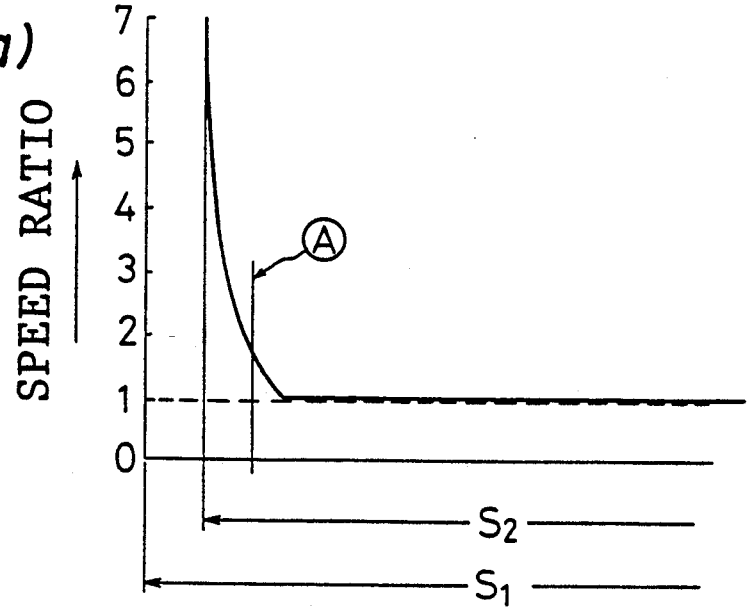
FIGS. 7 (*a*) to 7 (*f*) are diagrams showing the relationships between the speed ratio of the rotary blades and the traverse stroke.
Figure 7B:
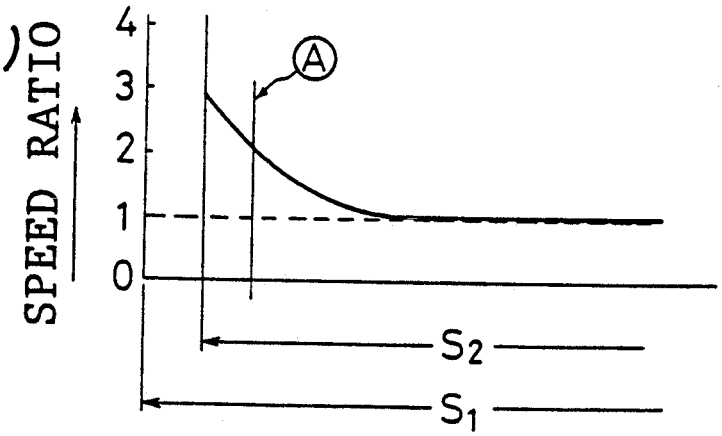
Figure 7C:
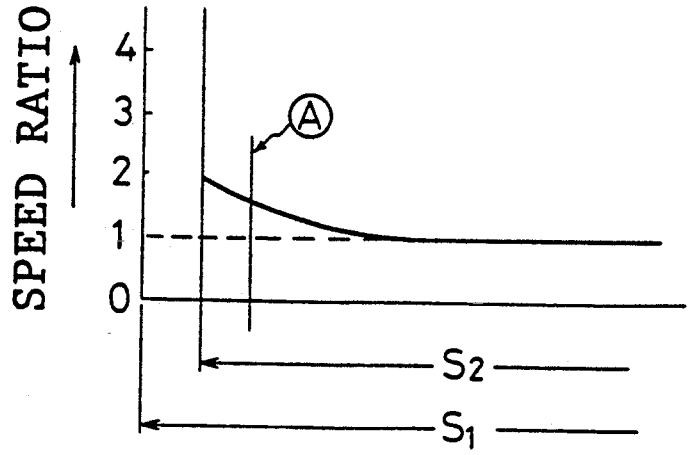
Figure 7D:
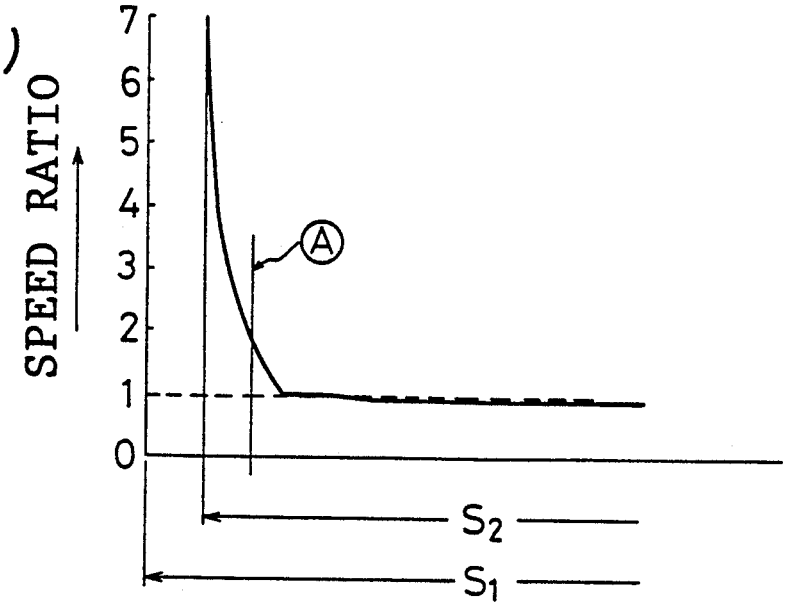
Figure 7E:
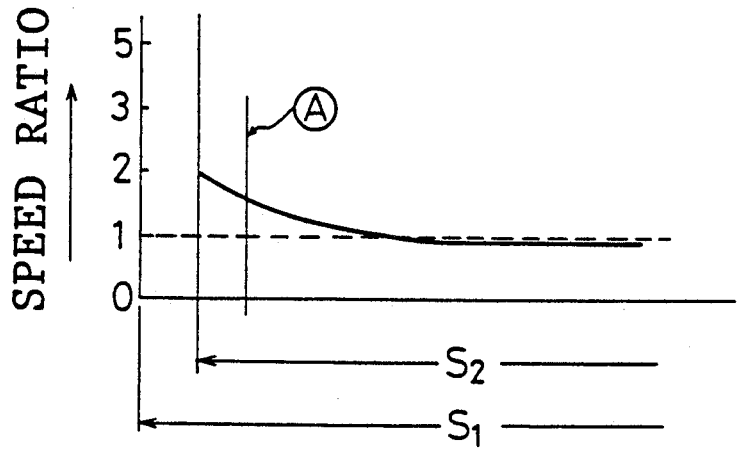
Figure 7F:
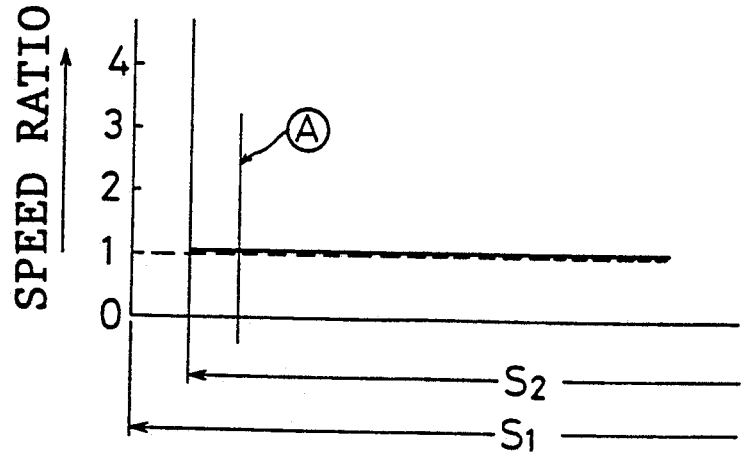
Figure 8A:
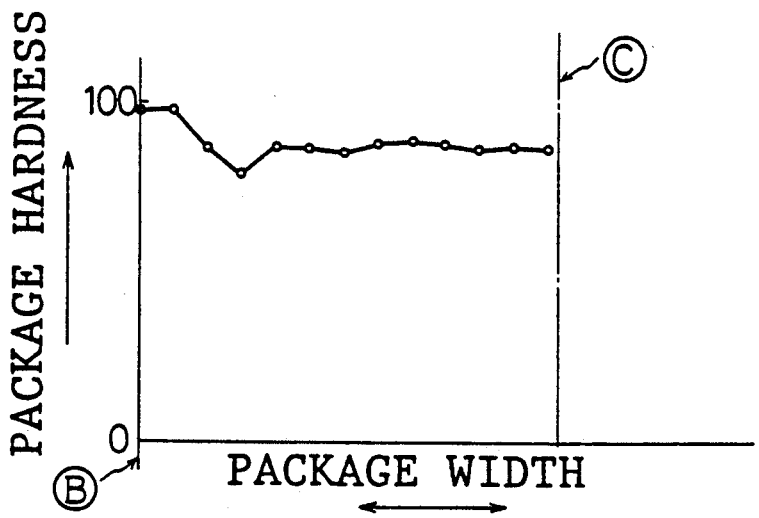
FIGS. 8 (*a*) to 8 (*f*) are diagrams corresponding to FIGS. 7 (*a*) to 7 (*f*) and showing the relationships between the width of packages and the hardness of the packages.
Figure 8B:
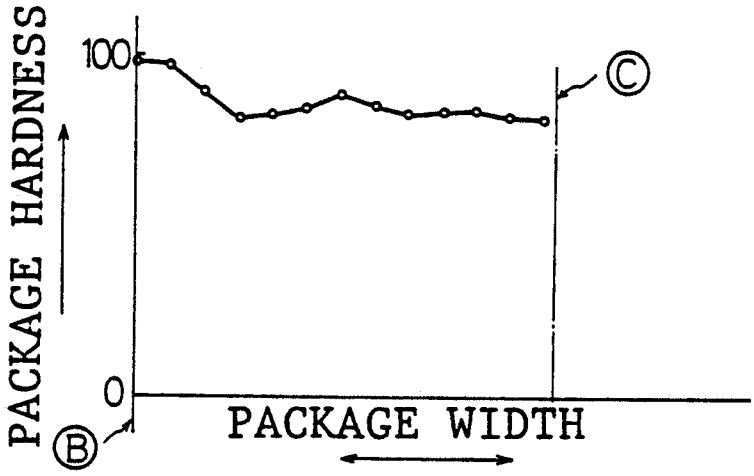
Figure 8C:
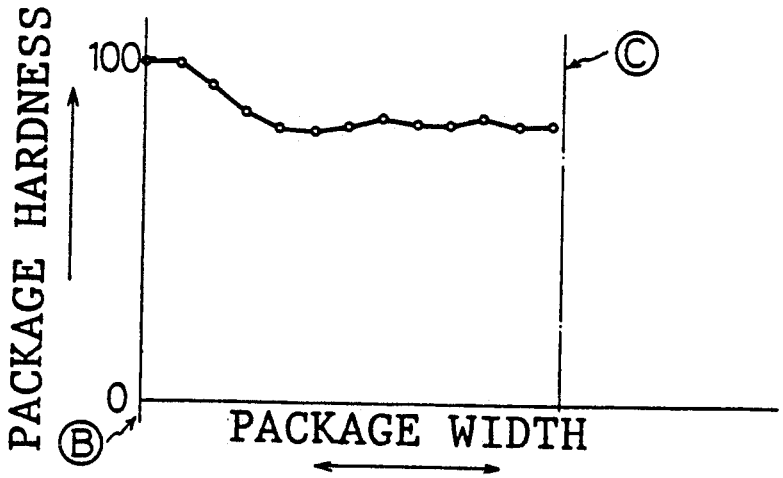
Figure 8D:
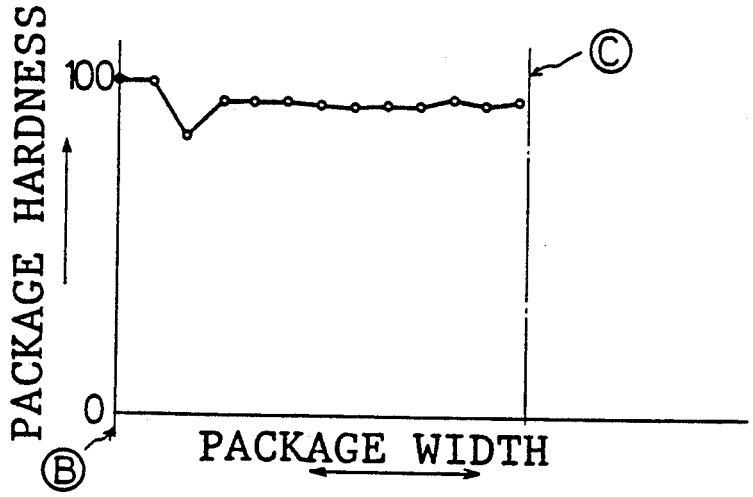
Figure 8E:
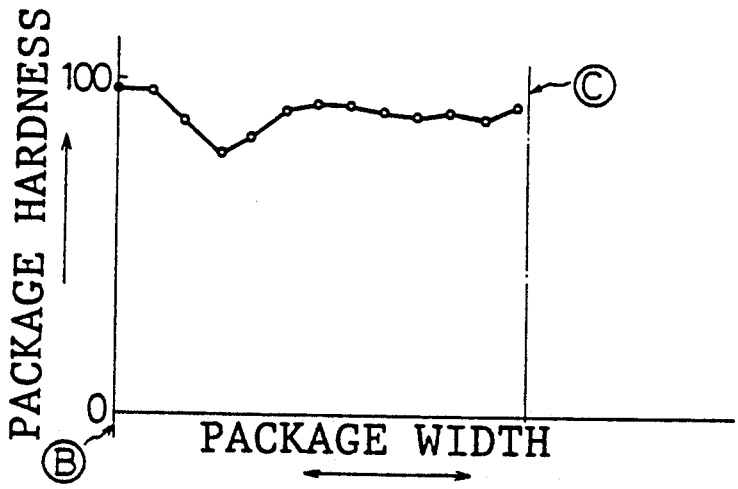
Figure 8F:
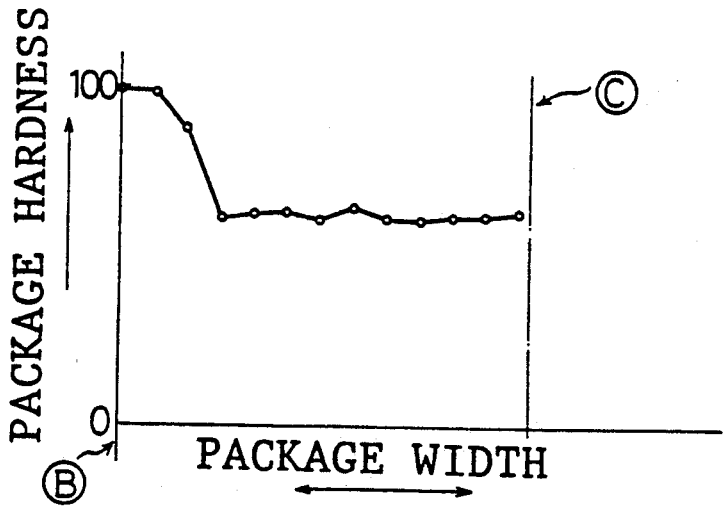

Referring to FIGS. 4, 5 and 6, the yarn transferring steps of the present invention will now be explained in detail.

At time ① in FIG. 4, a yarn Y is moved to the left by the rotary blade 24 of the first traverse means. The yarn Y is moved to the left at an almost constant speed from the center of traverse stroke. When the yarn Y reaches the turning point near the left end of the traverse stroke (condition denoted by ②), the yarn Y comes in contact with the rotary blade 26 which is rotating to the right. However, the rotary blade 24 continues to move the yarn Y to the left. At this time, the moving speed to the right of the rotary blade 26 of the second traverse means is seven times faster than the traversing speed V of the yarn Y near position denoted by ①. The speed of the rotary blade 26 may be in a range between 1.5 to 7 times of the yarn speed V.

The yarn is moved by the rotary blade 26 to a position slightly deviated toward the center of traverse stroke from an imaginary line connecting a point, where the yarn is in contact with the contact roller 4, and the rotary blade 24. Then, the yarn Y engages with the guide rail 37*a* of the upward member U1, and the yarn Y is released from the rotary blade 24.

In order to slightly deviate the yarn Y as described above, the traverse stroke S1 of the yarn conveyed by the rotary blade 24 is so selected that the following equation is satisfied.

$$S1 \geqq S0 + 2L1 \tan \theta$$

In this equation, the parameters are as follows: S0 is the stroke of the yarn Y wrapping around the contact roller 4;

L1 is a distance from the rotary blade 24 to the wrapping point on the contact roller; and $\theta$ is a winding angle of the yarn.

Further, the traverse stroke S2 when the rotary blade 26 engages with the yarn Y is so selected that the following equation is satisfied.

$$S2 \geqq S0 + 2L2 \tan \theta$$

In this equation, the parameter L2 is a distance from the rotary blade 26 to the wrapping point on the contact roller 4.

The yarn Y, which has been disengaged from the rotary blade 24, is gradually decreased in speed from an initial speed of 7V to a speed almost equal to V by the rotary blade 26 from a position denoted by ② to a position beyond the position ②′ where the winding angle $\theta$ is reversed, and then, the yarn Y is moved to the right by the rotary blade 26 as illustrated in ③ in FIG. 5.

The situations where the yarn Y reaches the left traverse end will now be explained in detail. As illustrated in FIG. 6 (*a*), the rotary blade 26 has an auxiliary blade portion 26*a* which is forked and with which the yarn Y is engaged. Thus, the yarn Y is restricted by the grooved portion 26*b* of the rotary blade 26 when the yarn Y is released from the rotary blade 24 so that adverse influences caused by moment of inertia and unstableness caused by sudden changes in tension of the yarn Y when the yarn Y is disengaged from the rotary blade 24 are prevented. The rotary blade 25 is similarly shaped. The grooved portions 25*b* and 26*b* extend in a lengthwise direction of the rotary blades 25 and 26 and hold the yarn at a region from the end of the traverse stroke illustrated in FIG. 6 (*a*) to the center of the traverse stroke illustrated in FIG. 6 (*b*).

FIG. 6 (*b*) shows the transfer of the yarn Y at time ③ in FIG. 5, and FIG. 6 (*c*) shows the transfer of the yarn Y at time ④ in FIG. 5.

When the yarn Y is transferred near the center of the traverse stroke as illustrated in ④ in FIG. 5, the yarn Y engages with the rotary blade 23 of the first traverse means, which is disposed upwardly from the rotary blade 26 of the second traverse means by a predetermined distance, and the yarn Y is moved to the right at a speed V.

After the rotary blade 23 reaches near an extended line of an imaginary straight line connecting the wrapping point of the yarn Y on the contact roller 4 and the rotary blade 26, the yarn Y, which has been conveyed by the rotary blade 26 and which is to be conveyed by the rotary blades 25 and 23, engages with the guide rail 38 of the downward traverse unit U2 as illustrated in FIG. 6 (*c*). Then, the yarn Y is disengaged from the rotary blade 26, and it is moved to the right by the rotary blade 23 of the first traverse means as illustrated in ⑤ in FIG. 5.

Thereafter, the yarn Y reaches the right end of the traverse stroke. When the yarn Y, which has been conveyed by the rotary blade 23, reaches the turning point (conditions denoted by ⑥ in FIGS. 4 and 5), it is engaged with the rotary blade 25 which is rotating to the left. At this moment, the rotary blade 23 continues to convey the yarn Y to the right. The yarn Y engages with the guide rail 37*a* of the upper traverse member U1 at a position where the yarn Y is slightly deviated by the rotary blade 25 from an imaginary straight line connecting the contacting point on the contacting roller 4 and the rotary blade 23, and the yarn Y is disengaged from the rotary blade 23.

Similar to the foregoing explanation, the traverse stroke S1 is so selected that $$S1 \geqq S0 + 2L1 \tan \theta, \text{ and the traverse stroke } S2 \text{ is so selected that}$$

$$S2 \leqq S0 + 2L2 \tan \theta.$$

The yarn Y disengaged from the rotary blades 23 is gradually decreased in speed from a speed of 7V to a speed of almost V by the rotary blade 25 until the winding angle is reversed in a manner similar to the above-described 2, and ②′, and it is moved to the left as denoted by ⑦ in FIG. 4.

When the yarn Y is moved near the center of the traverse stroke as denoted by ⑧ in FIG. 4, it engages with the rotary blade 24, which is disposed upwardly from the rotary blade 25 by a predetermined distance, and it is conveyed at a speed V by the rotary blade 24.

After the rotary blade 24 reaches near an extended line of an imaginary straight line connecting the wrapping point of the yarn Y on the contact roller 4 and the rotary blade 25, the yarn Y, which has been conveyed by the rotary blade 25 and which is to be conveyed by the rotary blade 24, engages with the guide rail 38 of the downward traverse unit U2. Then, the yarn Y is disengaged from the rotary blade 25, and it is moved to the left by the rotary blade 24 as illustrated by (1) in FIG. 4.

The yarn speeds during the above-described traversing operation are set by combinations of in the shapes of the rotary blades 24 and 23 and the guide rail 37*a*, and the rotary blades 25 and 26 and the guide rail 38*a*.

The above-described transfer of the yarn is repeated, and a yarn package is formed on the bobbin 6 inserted onto the bobbin holder 5.

The relationships between the yarn conveying speeds by the rotary blades of the present invention and the hardness of the outer periphery of the wound package will now be explained.

It is preferred that the difference in hardness of the outer periphery of the obtained package over the entire width of the package be small in order to minimize the uneveness in the yarn quality and to enhance the strength of the package. In order to meet this end, according to the present invention, the yarn conveying speeds of the rotary blades are specially designed. As a result, the difference in hardness of the outer periphery of the obtained package can be small according to the present invention. The inventive method will now be explained.

FIGS. 7 (*a*) to 7 (*f*) are diagrams showing the relationships between the traverse strokes and the yarn conveying speeds of the rotary blades, wherein the abscissa, i.e., X-axis, denotes the traverse stroke, and the ordinate, i.e., Y-axis denotes the speed ratio (a broken line) of the first traverse means to the traverse speed at the center of the traverse stroke and the speed ratio (a solid line) of the second traverse means to the traverse speed at the center of the traverse stroke. Reference numeral (A) denotes the position where the winding angle is reversed at the end of the traverse stroke. Further, FIGS. 8 (*a*) to 8 (*f*) show the hardness of the packages obtained by the speed illustrated in FIGS. 7 (*a*) to 7 (*f*).

The abscissa, i.e., X-axis, denotes the width of the package, (B) denotes the end of the package, (C) denotes the center of the package, and only the left half is illustrated since the package hardness is almost symmetrical for the left and right portions of the package.

The ordinate, i.e., Y-axis, denotes the package hardness which is a mean value of six packages measured by "Yarn Hardness" manufactured by Nakaasa Sokki, in Japan, at every 5 mm from the end of the packages. Since the hardness at position (B), which is the ends of the packages, cannot be measured, the value at the position 5 mm away from the position (B) is substituted therefor.

The data illustrated in FIG. 8 are obtained under the following winding conditions. Polyester drawn yarn of 75 de/36 filaments with a circular cross section is wound at a speed 5,600 m/min at a winding angle of 6.8° under a winding contacting pressure of 16 kg, at a winding tension between 14 and 16 g. The winding machine is of a spindle drive type, wherein six packages are wound on a single bobbin holder.

In FIGS. 7 (*a*) to 7 (*c*), the traverse speed of the first traverse means is almost constant, and the traverse speed of the second traverse means is increased to a value 2 to 7 times as large as that of the first traverse means at the end of the traverse stroke and is gradually decreased before the point (A). The package hardness of the obtained packages are correspondingly illustrated in FIGS. 8 (*a*) to 8 (*c*).

In FIGS. 7 (*d*) and 7 (*e*), the traverse speed of the second traverse means is decreased beyond that of the first traverse means at the center of the traverse stroke in order to minimize the difference in the package hardness. In FIG. 7 (*d*), the speed of the second traverse means is decreased by 5% relative to the constant speed, and in FIG. 7 (e), the speed of the second traverse means is decreased by 8% relative to the constant speed, the package hardness of the obtained packages are correspondingly illustrated in FIGS. 8 (*d*) and 8 (*e*).

FIG. 7 (*f*) shows the winding under the condition that the traverse speeds of the first and second traverse means are almost constant, and package hardness is illustrated in FIG. 8 (*f*).

In the explanations above, the decrease of the traverse speed at the center of the traverse stroke is performed by the second traverse means, however, it may be done only by the first traverse means, or by both the first and the second traverse means.

Although in the illustrated embodiment, the distance between the rotary blades 25 and 26 is larger than that of the rotary blades 23 and 24, the distances may be equal.

In the illustrated embodiment, as illustrated in FIG. 2, the rotary blades are integrally formed. However, as illustrated in FIGS. 9 (*a*) and 10 (*a*), holder 40 and yarn guide 41, which is, for example, made of ceramic, are separately formed and are secured to each other by bolts 42.

Figure 9A:
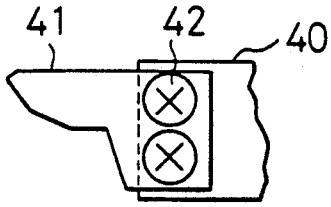
FIGS. 9 (*a*) to 9 (*c*) are plan views of other embodiments showing the method for securing the guides to the rotary blades FIGS. 10 (*a*) to 10 (*c*) are cross sectional views of FIGS. 9 (*a*) to 9 (*c*)
Figure 9B:
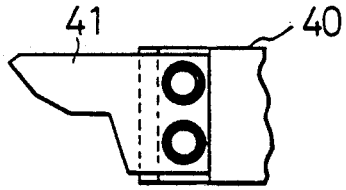
Figure 9C:
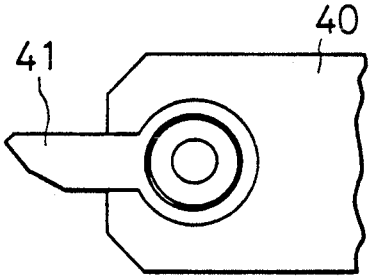
Figure 10A:
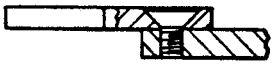
Figure 10B:
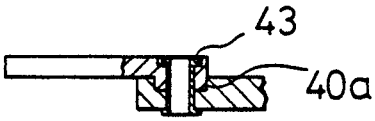
Figure 10C:
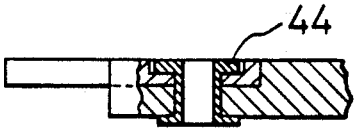

Further, as illustrated in FIGS. 9 (*b*) and 10 (*b*), the holder 40 and the yarn guide 41 may be rivetted 43 or secured by bolts, and the holder 40 may have an engaging shoulder portion 40*a* which receives centrifugal force.

In addition, as illustrated in FIGS. 9 (*c*) and 10 (*c*), the holder 40 and the yarn guide 41 may be separated and rivetted 44 or secured by bolts, and an engaging portion is formed in a circular recess so as to receive centrifugal force.

Figure 11:
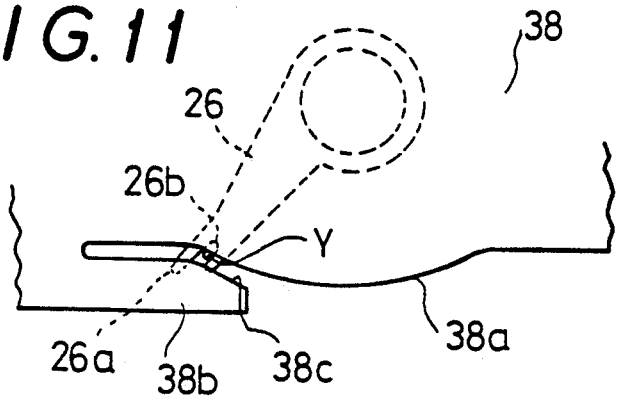
FIG. 11 is a plan view of another embodiment of the second traverse means.

When the guide yarn 38 has projections 38*b* at the ends of the guide rail 38*a* forming groove 38*c* as illustrated in FIG. 11, the yarn Y is securely guided into the grooved portion of the rotary blades 25 and 26 and is prevented from being pushed outwardly, i.e., downward direction in FIG. 11, by the rotary blades 25 and 26.

When the distance between the first traverse means and the second traverse means is excessively small, for example a distance between 5 and 10 mm in a conventional machine, the yarn may be rubbed between the rotary blades of both the traverse means, and accordingly, the obtained yarn may be remarkably deteriorated since fluffs may be created, and since unevenness in strength of the yarn may occur. It is preferred that the distance between the first and second traverse means is set between 15 and 70 mm.

Although in the above-described embodiments, the traversing apparatus is used to simultaneously wind two packages onto a bobbin holder, the number of the bobbins may be one or more than two.

The winding apparatus may be of an automatic type which has a plurality of bobbin holders.

Further, in the embodiments, the rotary blades 25 and 26 have recess portions 26*b*, the portion 26*b* in FIG. 6 may be omitted while the portion 26*a* is formed.

According to the yarn traversing apparatus of the present invention, a wound yarn package with a good wound shape and without cob-webbing can be obtained at a high speed winding, and uneveness in the yarn quality of the obtained yarn can be prevented.

What we claim is:

1. A method for traversing a yarn across a predetermined traverse stroke so as to wind said yarn on a bobbin by means of a traversing apparatus comprising a first traverse means for traversing said yarn and a second traverse means for traversing said yarn, which second traverse means is disposed downstream from said first traverse means by a predetermined distance, comprising the steps of:

traversing said yarn from a central portion of the traverse stroke to an end of the traverse stroke by means of one of said first and second traverse means;

simultaneously engaging said yarn with said first and second traverse means in a region adjacent to an end of said traverse stroke in such a manner that a winding path of said yarn is deflected in opposite directions by said first and second traverse means;

transferring said yarn from said one of said first and second traverse means to the other of said first and second traverse means at said region adjacent to an end of said traverse stroke;

traversing said yarn from said end of the traverse stroke to the central portion of the traverse stroke by means of said other traverse means; and transferring said yarn alternately between said first and second traverse mans so as to traverse said yarn across said predetermined traverse stroke from one end thereof to the other end thereof.

2. A traversing apparatus for traversing a yarn across a predetermined traverse stroke so as to wind said yarn on a bobbin, comprising:

first traverse means for traversing said yarn;

second traverse means for traversing said yarn, disposed downstream by a predetermined distance from said first traverse means;

said yarn being alternately transferred between said first and second traverse means so as to traverse across said predetermined traverse stroke from one end thereof to another end thereof; and said first and second traverse means simultaneously engaging with said yarn in regions adjacent to said ends of said traverse stroke in such a manner that a winding path of said yarn is deflected in opposite directions by said first and second traverse means.

3. A yarn traversing apparatus according to claim 2, wherein said first traverse means and said second traverse means comprise rotary blades provided with yarn guides, which rotary blades rotate in opposite directions.

4. A yarn traversing apparatus according to claim 2, which further comprises:

a frame downwardly inclined relative to the winding direction of said yarn;

said first traverse means comprising at least a pair of rotary blades being rotatably supported on said frame;

centers of rotation of said rotary blades of said first traverse means being located near said ends of said traverse stroke; and said second traverse means comprising at least a pair of rotary blades being rotatably supported on said frame;

centers of rotation of said rotary blades of said second traverse means being located near said ends of said traverse stroke.

5. A yarn traversing apparatus according to claim 4, wherein said centers of rotation of said rotary blades of said second traverse means are located in front of said centers of rotation of said rotary blades of said first traverse means, said apparatus further comprising:

first rotational spindle means for rotatably supporting said first traverse means at one end thereof about first axes of rotation; and second rotational spindle means, mounted adjacent said first rotational spindle means and being rotationally engaged therewith, for rotationally supporting said second traverse means at one end thereof opposite said one end of said first rotational spindle means, about second axes of rotation parallel to said first axes of rotation.

6. A yarn traversing apparatus according to claim 2, wherein $$S1 \geqq S0 + 2L1 \tan \theta$$

$$S2 \leqq S0 + 2L2 \tan \theta$$

in which:

S1 is the stroke of said first traverse means from the position at which it engages said yarn to the position at which it releases said yarn;

S2 is the stroke of said second traverse means from the position at which it engages said yarn to the position at which it releases said yarn;

S0 is the stroke of said yarn across said contact roller;

L1 is the distance from said first traverse means to a point where said yarn contacts said contact roller;

L2 is the distance from said second traverse means to said point where said yarn contacts said contact roller; and $\theta$ is the winding angle of said yarn.

7. A yarn traversing apparatus according to claim 2, wherein said first traverse means comprises a rotary blade moving from a central portion of said traverse stroke toward said ends of traverse stroke and a guide rail restricting a speed of said yarn conveyed by said rotary blade, so that speed of said yarn conveyed by said first traverse means is made substantially constant; and said second traverse means comprises a rotary blade moving from said ends of traverse stroke toward said central portion of said traverse stroke and a guide rail restricting a speed of said yarn conveyed by said rotary blade of said second traverse means, so that a speed of said yarn conveyed by said second traverse means is made almost the same as that of said first traverse means at said central portion of said traverse stroke and is gradually decreased from a speed between 1.5 and 7 times of that of said first traverse means to that of said first traverse means at said ends of said traverse stroke.

* * * * *

UNITED STATES PATENT AND TRADEMARK OFFICE

CERTIFICATE OF CORRECTION

PATENT NO. : 5,282,582

DATED : February 1, 1994

INVENTOR(S) : Takami Sugioka et al.

It is certified that error appears in the above-identified patent and that said Letters Patent is hereby corrected as shown below:

Col. 2, line 17, "and," should be --, and--.

Col. 2, line 60, "S2≧" should be --S2≦--.

Col. 4, line 38, "member" should be --members--.

Col. 4, line 55, after "the" insert --same--.

Col. 7, line 9, delete "in".

Signed and Sealed this

Twenty-first Day of June, 1994

Bruce Lehman

*Attest:*

BRUCE LEHMAN

*Attesting Officer*

*Commissioner of Patents and Trademarks*